US011571916B2

(12) United States Patent
Sato et al.

(10) Patent No.: US 11,571,916 B2
(45) Date of Patent: Feb. 7, 2023

(54) PRINTING APPARATUS AND HEATING DEVICE

(71) Applicant: CANON KABUSHIKI KAISHA, Tokyo (JP)

(72) Inventors: Ryosuke Sato, Kanagawa (JP); Yusuke Nakaya, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 24 days.

(21) Appl. No.: 17/166,115

(22) Filed: Feb. 3, 2021

(65) Prior Publication Data

US 2021/0155017 A1 May 27, 2021

Related U.S. Application Data

(63) Continuation of application No. PCT/JP2019/021112, filed on May 28, 2019.

(30) Foreign Application Priority Data

Aug. 7, 2018 (JP) ..... JP2018-148719

(51) Int. Cl.
*B41J 2/01* (2006.01)
*B41J 11/00* (2006.01)
*B41J 11/04* (2006.01)

(52) U.S. Cl.
CPC .... *B41J 11/00212* (2021.01); *B41J 11/00222* (2021.01); *B41J 11/04* (2013.01)

(58) Field of Classification Search
None
See application file for complete search history.

(56) References Cited

U.S. PATENT DOCUMENTS

| | | | |
|---|---|---|---|
| 4,434,562 | A | 3/1984 | Bubely et al. |
| 5,502,476 | A | 3/1996 | Neal et al. |
| 6,439,712 | B1 | 8/2002 | Mizutani et al. |
| 8,548,368 | B2 | 10/2013 | Hollands et al. |
| 10,479,124 | B2 | 11/2019 | Moriguchi et al. |
| 10,486,417 | B2 | 11/2019 | Tsushima et al. |
| 10,493,782 | B2 | 12/2019 | Sato et al. |
| 10,500,839 | B2 | 12/2019 | Sato et al. |

(Continued)

FOREIGN PATENT DOCUMENTS

| | | | |
|---|---|---|---|
| JP | 58-74360 | A | 5/1983 |
| JP | 07-276621 | A | 10/1995 |
| JP | 08-224871 | A | 9/1996 |

(Continued)

OTHER PUBLICATIONS

International Search Report and Written Opinion dated Jul. 9, 2019, in International Patent Application No. PCT/JP2019/021112.

*Primary Examiner* — Erica S Lin
*Assistant Examiner* — Tracey M McMillion
(74) *Attorney, Agent, or Firm* — Venable LLP

(57) ABSTRACT

A printing apparatus includes a printing unit configured to form an ink image by discharging ink on a medium, and a heating unit configured to heat the ink image on the medium. The heating unit includes a heat generating unit configured to generate radiant heat, a reflecting unit that includes a reflecting surface configured to reflect the radiant heat of the heat generating unit, and a cooling unit configured to cool the reflecting surface by supplying a gas to the reflecting surface.

19 Claims, 13 Drawing Sheets

(56) References Cited

U.S. PATENT DOCUMENTS

| | | | | |
|---|---|---|---|---|
| 2003/0227527 | A1 | 12/2003 | Richards | |
| 2013/0328983 | A1* | 12/2013 | Thayer | B41J 11/0024 347/103 |

FOREIGN PATENT DOCUMENTS

| | | | | | |
|---|---|---|---|---|---|
| JP | 2000-211116 | A | | 8/2000 | |
| JP | 2004-351757 | A | | 12/2004 | |
| JP | 2006-035648 | A | | 2/2006 | |
| JP | 2008-149560 | A | | 7/2008 | |
| JP | 2012-517609 | A | | 8/2012 | |
| JP | 2014019023 | A | * | 2/2014 | B05C 1/0813 |

* cited by examiner

PRINTING APPARATUS AND HEATING DEVICE

CROSS-REFERENCE TO RELATED APPLICATIONS

This application is a Continuation of International Patent Application No. PCT/JP2019/021112, filed May 28, 2019, which claims the benefit of Japanese Patent Application No. 2018-148719, filed Aug. 7, 2018, both of which are hereby incorporated by reference herein in their entirety.

BACKGROUND OF THE INVENTION

Field of the Invention

The present invention relates to a printing technique.

Background Art

There is known a technique for heating, for the purpose of drying or improving transferability in a transfer-type printing apparatus, an ink image formed by discharging ink from a printhead. For example, PTL 1 discloses a technique for heating an ink image by radiant heat before the transfer of the ink image, and particularly discloses a structure that includes a reflector for reflecting the radiant heat.

CITATION LIST

Patent Literature

PTL 1: Japanese Patent Laid-Open No. 2012-517609

However, in the arrangement of PTL 1, a reflecting surface that reflects the radiant heat may degrade due to the influence of the heat. The degradation of the reflecting surface will reduce the reflectance, thus degrading the heating efficiency of the ink image.

The present invention provides a technique for suppressing the degradation of a reflecting surface that reflects radiant heat.

SUMMARY OF THE INVENTION

According to an aspect of the present invention, there is provided a printing apparatus comprising a printing unit configured to form an ink image by discharging ink on a medium, and a heating unit configured to heat the ink image on the medium, wherein the heating unit includes a heat generating unit configured to generate radiant heat, a reflecting unit that includes a reflecting surface configured to reflect the radiant heat of the heat generating unit, and a cooling unit configured to cool the reflecting surface by supplying a gas to the reflecting surface.

Further features of the present invention will become apparent from the following description of exemplary embodiments (with reference to the attached drawings).

DESCRIPTION OF THE EMBODIMENTS

An embodiment of the present invention will be described with reference to the accompanying drawings. In each drawing, arrows X and Y denote horizontal directions which are perpendicular to each other. An arrow Z denotes a vertical direction.

<Printing System>

Figure 1:
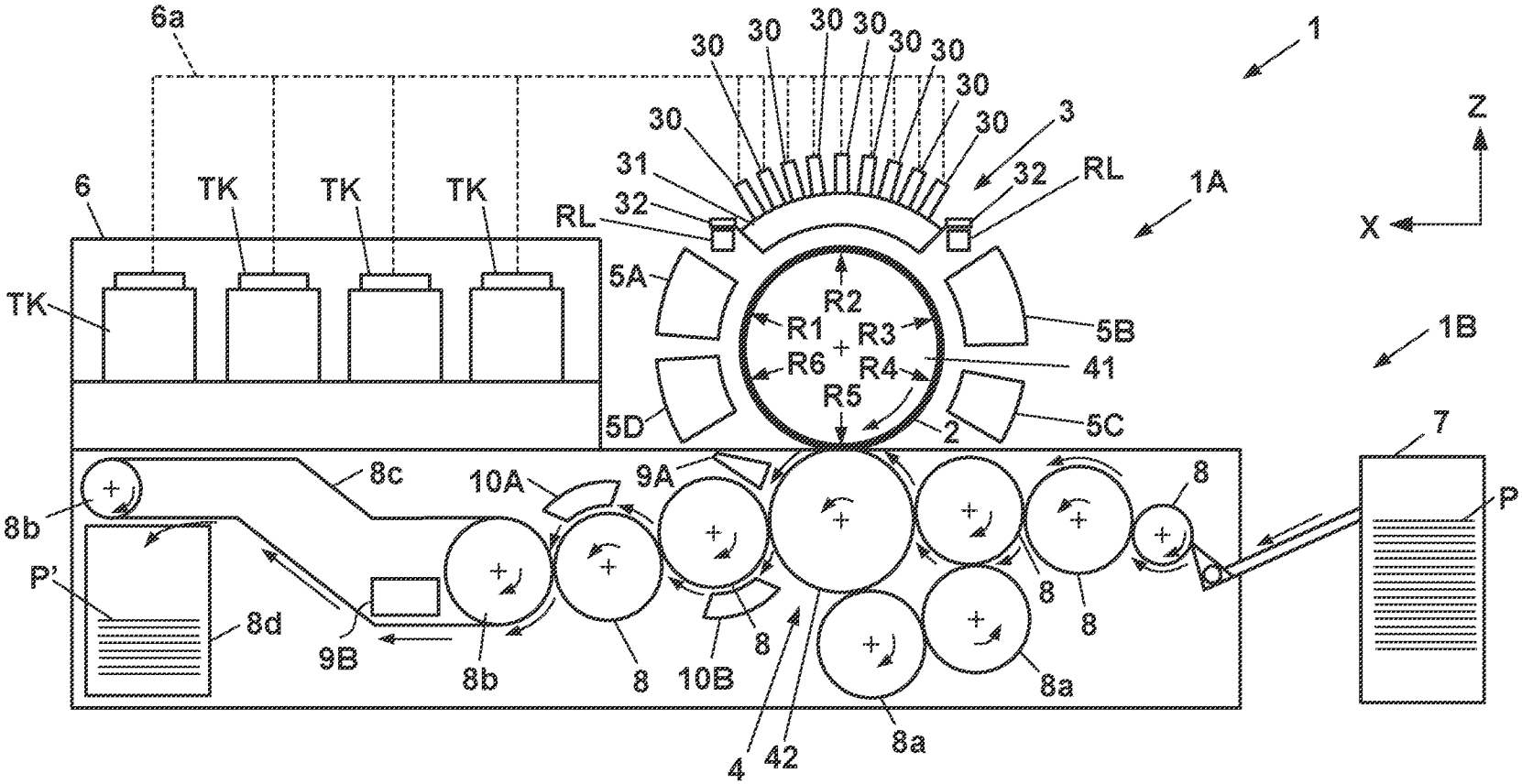
FIG. 1 is a schematic view showing a printing system.

FIG. 1 is a front view schematically showing a printing system (printing apparatus) 1 according to an embodiment of the present invention. The printing system 1 is a sheet inkjet printer that manufactures a printed product P' by transferring an ink image on a print medium P via a transfer member 2. The printing system 1 includes a printing apparatus 1A and a conveyance apparatus 1B. In this embodiment, an X direction, a Y direction, and a Z direction denote a widthwise direction (total length direction), a depth direction, and a height direction, respectively, of the printing system 1. The print medium P is conveyed in the X direction.

Note that the term "print" includes not only the formation of significant information such as a character, a graphic pattern, or the like, but also includes, in a broader sense, the formation of an image, a design, or a pattern on print media or processing of print media, regardless of whether the information is significant or insignificant or regardless of whether the information has been manifested to allow visual perception by a human. In addition, although "print media" are assumed to be paper sheets in this embodiment, they may be cloth, plastic films, or the like.

Although the component of ink is not particularly limited, this embodiment will assume a case that uses an aqueous pigment-based ink including a pigment as a coloring material, water, and resin.

<Printing Apparatus>

The printing apparatus 1A includes a print unit 3, a transfer unit 4, peripheral units 5A to 5D, and a supply unit 6.

<Printing Unit>

Figure 2:
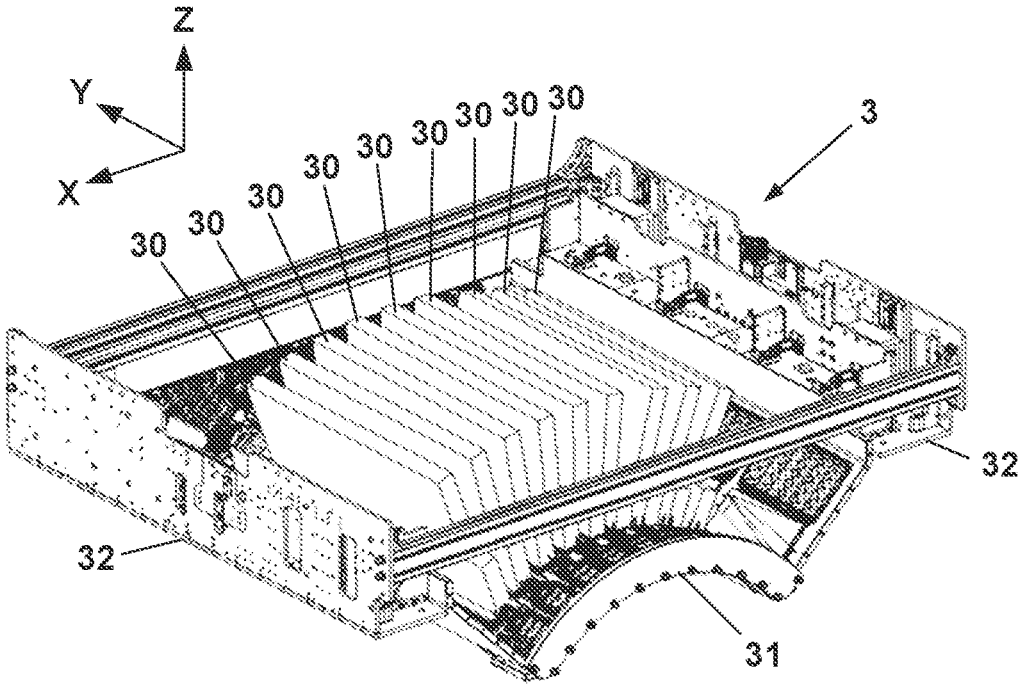
FIG. 2 is a perspective view showing a printing unit.

The print unit 3 includes a plurality of printheads 30 and a carriage 31, referring to FIGS. 1 and 2. FIG. 2 is a perspective view of the print unit 3. The printheads 30 discharge liquid ink to the transfer member 2 to form an ink image of a printed image on the transfer member 2.

In this embodiment, each printhead 30 is a full-line printhead extending in the Y direction, and nozzles are arranged, in each printhead, in a range that covers the width of an image printing region of a print medium of a maximum usable size. Each printhead 30 includes, on its lower surface, an ink discharge surface with nozzle openings, and the ink discharge surface faces the front surface of the transfer member 2 with a minute gap (of, for example, several mm) intervening between them. In this embodiment, since the transfer member 2 is arranged to move cyclically along a circular orbit, the plurality of printheads 30 are arranged radially.

A discharge element is arranged in each nozzle. The discharge element is, for example, an element that causes ink in a nozzle to be discharged by generating pressure in the nozzle, and a known technique for an inkjet printhead of an inkjet printer can be applied. For example, an element that discharges ink by forming air bubbles by using an electrothermal transducer to generate film boiling in ink, an element that discharges ink by using an electromechanical transducer, and an element that discharges ink by using static electricity, or the like can be used as the discharge element. A discharge element that uses an electrothermal transducer can be used from the point of view of high-speed and high-density printing.

Nine printheads 30 are provided in this embodiment. The printheads 30 discharge different kinds of inks. The different kinds of inks include, for example, inks of different coloring materials and are inks such as yellow ink, magenta ink, cyan ink, black ink, and the like. Although one printhead 30 will discharge one kind of ink, it may be arranged so that one printhead 30 will discharge a plurality of kinds of inks. In a case in which the plurality of printheads 30 are arranged in this manner, some of the printheads may discharge ink (for example, clear ink) which does not include a coloring material.

The carriage 31 supports the plurality of printheads 30. The ends on the side of the ink discharge surface side of each printhead 30 are fixed to the carriage 31. As a result, the gap between the ink discharge surface and the front surface of the transfer member 2 can be maintained more precisely. The carriage 31 is formed to be displaceable, by the guidance of guide members RL, while mounting the printheads 30. In this embodiment, the guide members RL are formed in a rail structure extending in the Y direction and arranged as a pair spaced apart from each other in the X direction. A slide portion 32 is arranged on each side of the carriage 31 in the X direction. The slide portions 32 engage with the guide members RL and slide in the Y direction by the guidance of the guide members RL.

Figure 3:
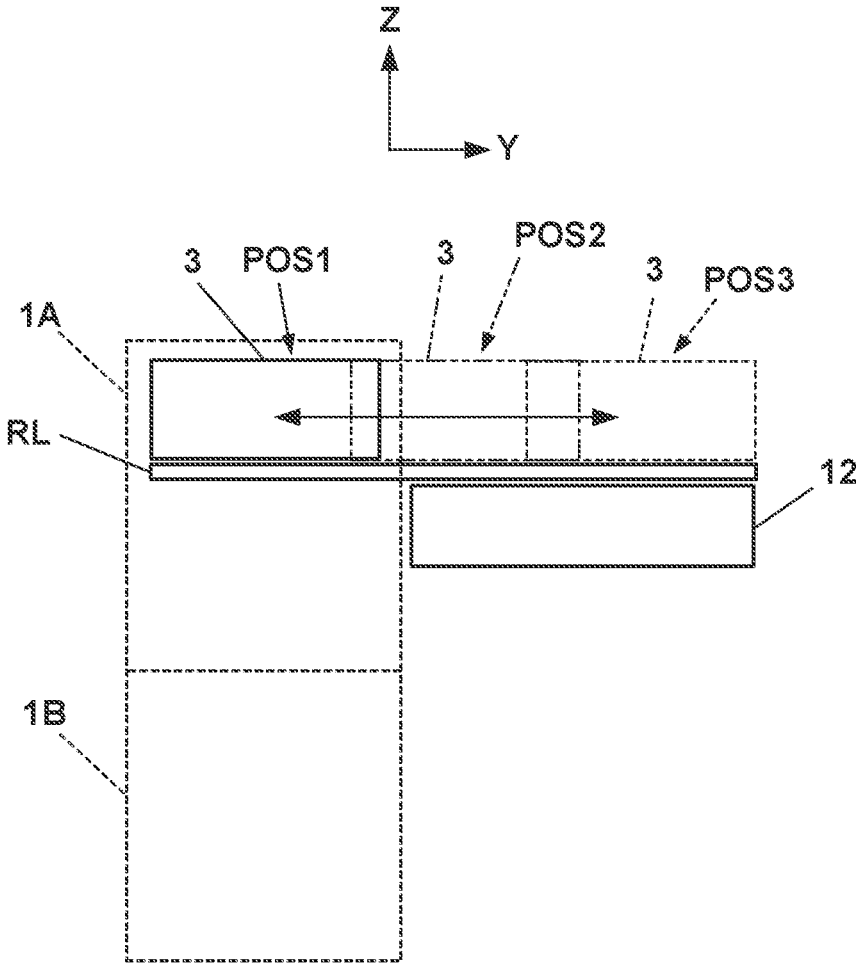
FIG. 3 is an explanatory view showing a displacement mode of the printing unit in FIG. 2.

FIG. 3 shows a displacement mode of print unit 3, and is a view schematically showing a right side surface of the printing system 1. A recovery unit 12 is arranged in the rear portion of the printing system 1. The recovery unit 12 includes a mechanism for recovering the discharge performance of the printheads 30. Such a mechanism may be, for example, a cap mechanism that caps the ink discharge surfaces of the printheads 30, a wiper mechanism that wipes the ink discharge surfaces, or a suction mechanism that uses negative pressure to suck ink in each printhead 30 from the discharge surface.

The guide members RL are arranged extending over the recovery unit 12 from the side of the transfer member 2. The print unit 3 is moved by a driving mechanism (not shown) and can be displaced, by the guidance of the guide members RL, between a discharge position POS1 indicated by a solid line in the print unit 3 and a recovery position POS3 indicated by broken lines in print unit 3.

The discharge position POS1 is a position where the print unit 3 discharges ink to the transfer member 2, and is a position where the ink discharge surface of each printhead 30 faces the front surface of the transfer member 2. The recovery position POS3 is a position retracted from the discharge position POS1, and is a position where the print unit 3 will be positioned above the recovery unit 12. When the print unit 3 is positioned in the recovery position POS3, the recovery unit 12 can execute a performance recovery process on the printheads 30. In this embodiment, the recovery process can also be executed during the movement of the print unit 3 before the print unit reaches the recovery position POS3. A preliminary recovery position POS2 is also present between the discharge position POS1 and the recovery position POS3. The recovery unit 12 can execute a preliminary recovery process on the printheads 30 at the preliminary recovery position POS2 while the printheads 30 are moving from the discharge position POS1 to the recovery position POS3.

<Transfer Unit>

The transfer unit 4 will be described with reference to FIG. 1. The transfer unit 4 includes a transfer drum (transfer cylinder) 41 and a pressurizing drum 42. These drums are rotating members that rotate about a rotational axis in the Y direction, and each drum includes a cylindrical outer peripheral surface. In FIG. 1, each of the arrows indicated in the respective drawings of the transfer drum (transfer cylinder) 41 and the pressurizing drum 42 indicates a corresponding rotational direction. The transfer drum 41 rotates clockwise, and the pressurizing drum 42 rotates anticlockwise.

The transfer drum 41 is a support member that supports the transfer member 2 on its outer peripheral surface. The transfer member 2 is arranged continuously or intermittently, in a circumferential direction, on the outer peripheral surface of the transfer drum 41. If arranged continuously, the transfer member 2 will be formed as an endless belt. If arranged intermittently, the transfer member 2 will be formed divided into a plurality of belt segments with ends, and each segment can be arranged in an arc at an equal pitch on the outer peripheral surface of the transfer drum 41.

The transfer member 2 moves cyclically on a circular orbit by the rotation of the transfer drum 41. The positions of the transfer member 2 can be discriminated, based on the rotational phase of the transfer drum 41, as a pre-discharge processing region R1, a discharge region R2, post-discharge processing regions R3 and R4, a transfer region R5, and a post-transfer processing region R6. The transfer member 2 passes through these regions cyclically.

The pre-discharge processing region R1 is a region for performing preprocessing on the transfer member 2 before the ink discharge by the print unit 3, and is a region where the application unit 5A performs processing. A reaction liquid will be applied in this process in this embodiment. The discharge region R2 is a formation region where the print unit 3 discharges ink onto the transfer member 2 to form an ink image. The post-discharge processing regions R3 and R4 are processing regions where processing will be performed on the ink image after the ink discharge. The post-discharge processing region R3 is a region where the peripheral unit 5B performs processing, and the post-discharge processing region R4 is a region where the peripheral unit 5C performs processing. The transfer region R5 is a region where the ink image on the transfer member is transferred to the print medium P by the transfer unit 4. The post-transfer processing region R6 is a region where post-processing is performed on the transfer member 2 after the transfer, and is a region where the peripheral unit 5D performs processing.

In this embodiment, the discharge region R2 is a region that includes a predetermined section. The sections of the other regions R1 and R3 to R6 are narrower than the section of the discharge region R2. In this embodiment, when compared to the face of a clock, the pre-discharge processing region R1 is positioned approximately at 10 o'clock, the discharge region R2 is positioned approximately in the range of 11 o'clock to 1 o'clock, the post-discharge processing region R3 is positioned approximately at 2 o'clock, and the post-discharge processing region R4 is positioned approximately at 4 o'clock. The transfer region R5 is positioned approximately at 6 o'clock, and the post-transfer processing region R6 is positioned approximately at 8 o'clock.

The transfer member 2 may be a single layer, but may also be a stacked member formed by a plurality of layers. If the transfer member is to be formed by a plurality of layers, it may include three layers which are, for example, a surface layer, an elastic layer, and a compression layer. The surface layer is an outermost layer that includes an image forming surface on which the ink image is to be formed. Arranging the compression layer will allow the compression layer to absorb deformation and disperse a local pressure fluctuation, thereby allowing the transferability to be maintained even at the time of high-speed printing. The elastic layer is a layer between the surface layer and the compression layer.

Although various kinds of materials such as a resin, ceramic, and the like can be used as the material of the surface layer, a material with a high compressive modulus of elasticity can be used in the point of durability or the like. More specifically, an acrylic resin, an acrylic silicone resin, a fluoride-containing resin, a condensate obtained by condensing a hydrolyzable organosilicon compound, or the like may be used. The surface layer that has undergone a surface treatment may be used in order to improve wettability of the reactive liquid, the transferability of an image, or the like. Frame processing, corona treatment, plasma treatment, polishing treatment, roughening treatment, active energy beam irradiation treatment, ozone treatment, surfactant treatment, silane coupling treatment, or the like can be performed as the surface treatment. These processing and treatments may be combined and performed. Furthermore, an arbitrary surface shape may be provided on the surface layer.

For example, acrylonitrile-butadiene rubber, acrylic rubber, chloroprene rubber, urethane rubber, silicone rubber, or the like can be used as the material of the compression layer. When such a rubber material is to be formed, a porous rubber material may be formed by mixing a predetermined amount of a vulcanizing agent, vulcanizing accelerator, or the like and further mixing, as needed, a foaming agent or a filling agent such as fine hollow particles or salt. Since an air bubble portion will be compressed along with a volume change in accordance with various pressure fluctuations, deformation in directions other than the compression direction will be small, and a more stable transferability and durability can be obtained for the material. Although a material having an open cell structure formed by pores which are continuous with each other and a material having a closed cell structure formed by pores which are independent of each other are available as porous rubber materials, either structure may be used for the porous material or a material obtained by combining these structure may be used.

Various kinds of materials such as a resin, ceramic, and the like can be used as a member of the elastic layer. Various kinds of elastomer materials, a rubber material, and the like can be used as the member of the elastic layer with respect to the processing characteristics. More specifically, for example, fluorosilicone rubber, phenyl silicone rubber, fluorine rubber, chloroprene rubber, urethane rubber, nitrile rubber, and the like may be used. In addition, ethylene propylene rubber, natural rubber, styrene rubber, isoprene rubber, butadiene rubber, the copolymer of ethylene/propylene/butadiene, nitrile-butadiene rubber, and the like may be used. In particular, since silicone rubber, fluorosilicone rubber, and phenyl silicon rubber have a low compression set, they are advantageous in terms of dimensional stability and durability. They are also advantageous in terms of transferability because they have a low modulus of elasticity with respect to the temperature.

Various kinds of adhesives, double-sided adhesive tapes, and the like can be applied between the surface layer and the elastic layer and between the elastic layer and the compression layer to fix these layers. The transfer member 2 can also include a reinforcement layer with a high compressive modulus of elasticity to maintain resilience and to suppress elongation in the horizontal direction when the transfer member is attached to the transfer drum 41. A woven fabric may be used as the reinforcement layer. The transfer member 2 can be formed by arbitrarily combining the respective layers made of the materials described above.

The outer peripheral surface of the pressurizing drum 42 is pressed against the transfer member 2. At least one gripping mechanism for gripping the leading edge portion of the print medium P is arranged on the outer peripheral surface of the pressurizing drum 42. A plurality of gripping mechanisms may be arranged spaced apart from each other in the circumferential direction of the pressurizing drum 42. The print medium P is conveyed in close contact with the outer peripheral surface of the pressurizing drum 42, and the ink image on the transfer member 2 is transferred to the print medium P when the print medium P passes through a nip portion between the pressurizing drum 42 and the transfer member 2.

A common driving source such as a motor or the like can be used to drive the transfer drum 41 and the pressurizing drum 42, and the driving force can be distributed by a transmission mechanism such as gear mechanism or the like.

<Peripheral Units>

The peripheral units 5A to 5D are arranged around a transfer drum 41. In this embodiment, the peripheral units 5A to 5D are an application unit, an absorption unit, a heating unit, and a cleaning unit, respectively.

The application unit 5A is a mechanism for applying the reaction liquid to the transfer member 2 before the ink discharge by the print unit 3. The reaction liquid is a liquid that contains a component that increases the viscosity of ink. A state in which the viscosity of ink has increased is a state in which a resin or a coloring material forming the ink has chemically reacted upon coming into contact with a component that increases the viscosity of the ink or has physically absorbed the component that increases the viscosity of the ink, thus leading to a state in which an increase in the viscosity of the ink can be confirmed. This increase in the viscosity of ink includes not only a case in which an increase in the viscosity of the ink overall, but also a case in which the viscosity increases locally in the ink due to the coagulation of a portion of a component, such as a coloring material or resin, which forms the ink.

The component that increases the viscosity of the ink can be metal ions, a polymeric coagulant or the like, and is not particularly limited. The component can be a substance which causes the coloring material in the ink to coagulate by causing a pH change in the ink, and an organic acid can be used. As the application mechanism of the reaction liquid, for example, a roller, a printhead, a die coating device (die coater), a blade coating device (blade coater), or the like can be used. Applying the reaction liquid to the transfer member 2 before the ink is discharged onto the transfer member 2 will allow the ink that has reached the transfer member 2 to be fixed immediately. As a result, bleeding caused by the mixing of adjacent inks can be suppressed.

The absorption unit 5B is a mechanism for sucking a liquid component from the ink image on the transfer member 2 before the transfer of the image. Reducing the liquid component of the ink image will allow bleeding or the like of the image to be printed on the print medium P to be suppressed. From a different point of view, the reduction in the liquid component can be described as the condensation of the ink forming the ink image on the transfer member 2. The condensation of the ink represents that the content ratio of solid components such as the coloring material or resin to the liquid component in the ink will be increased due to the reduction in the liquid component of the ink.

The absorption unit 5B includes, for example, a liquid absorbing member that reduces the amount of the liquid component of the ink image by coming into contact with the ink image. The liquid absorbing member may be formed on the outer peripheral surface of the roller or may be formed to have an endless sheet shape that can run cyclically. From the point of protecting the ink image, it may be arranged so that the liquid absorbing member will move in synchronization with the transfer member 2 by making the speed of movement of the liquid absorbing member be equal to the circumferential speed of the transfer member 2.

The liquid absorbing member can include a porous body that comes into contact with the ink image. To suppress the adherence of the solid components of the ink to the liquid absorbing member, the pore size of the porous body on the surface which is to come into contact with the ink image can be 10 μm or less. In this case, the pore size indicates the average diameter and can be measured by a known means such as mercury intrusion porosimetry, a nitrogen absorption method, SEM image observation, or the like. Note that the liquid component is not particularly limited as long as it does not have a predetermined shape, has fluidity, and has a substantially constant volume. For example, water or an organic solvent or the like contained in the ink or the reaction liquid can be raised as the liquid component.

The heating unit 5C is a mechanism for heating the ink image on the transfer member 2 before the transfer of the ink image. Heating the ink image will melt the resin in the ink image and improve the transferability to the print medium P. The heating temperature can be equal to or higher than a minimum film forming temperature (MFT) of the resin. The MFT can be measured by an apparatus which is in compliance with a generally known method such as JIS K 6828-2: 2003 or ISO2115: 1996. From the point of view of transferability and robustness of the image, the ink image can be heated at a temperature higher than the MFT by 10° C. or more or may be heated further at a temperature higher than the MFT by 20° C. or more. For example, various kinds of lamps of infrared light or the like, a warm air fan, a known heating device, or the like can be used as the heating unit 5C. An infrared heater can be used in terms of heating efficiency.

The cleaning unit 5D is a mechanism for cleaning the transfer member 2 after the transfer of the image. The cleaning unit 5D removes ink remaining on the transfer member 2 and dust on the transfer member 2. The cleaning unit 5D can appropriately use, for example, a known method such as a method of bringing a porous member into contact with the transfer member 2, a method of scrubbing the surface of the transfer member 2 with a brush, a method of scraping the surface of the transfer member 2 with a blade, or the like. A cleaning member to be used in the cleaning may have a known shape such as roller shape, a web shape, or the like.

As described above, although this embodiment includes the application unit 5A, the absorption unit 5B, the heating unit 5C, and the cleaning unit 5D as the peripheral units, a cooling function for the transfer member 2 may be added to some of these units or a cooling unit may be added. In this embodiment, the temperature of the transfer member 2 may rise due to the heat from the heating unit 5C. The liquid component suction performance of the absorption unit 5B may degrade if the ink image exceeds the boiling point of water, which is the main solvent of the ink, after the print unit 3 has discharged the ink onto the transfer member 2. By cooling the transfer member 2 so that the discharged ink will be maintained at a temperature less than the boiling point of water, the liquid component suction performance can be maintained.

The cooling unit can be an air blowing mechanism for blowing air to the transfer member 2 or a mechanism that brings a member (for example, a roller) into contact with the transfer member 2 and cools this member by air cooling or water cooling. Alternatively, the cooling unit may be a mechanism for cooling the cleaning member of the cleaning unit 5D. The cooling timing can be a period after the transfer of the image or before the application of the reaction liquid.

<Supplying Unit>

The supply unit 6 is a mechanism for supplying ink to each printhead 30 of the print unit 3. The supply unit 6 can be arranged on the rear portion side of the printing system 1. The supply unit 6 includes a reservoir TK that stores ink for each type of ink. Each reservoir TK may be formed by a main tank and a sub-tank. Each reservoir TK and a corresponding one of the printheads 30 communicate via a channel 6*a*, and ink is supplied from the reservoir TK to the corresponding printhead 30. The channel 6*a* may be a channel to allow the ink to circulate between the reservoir TK and the corresponding printhead 30, and the supply unit 6 may include a pump for circulating the ink. A deaeration mechanism for deaerating air bubbles in the ink may be arranged in the middle of the channel 6*a* or the reservoir TK. A valve that adjusts the liquid pressure of the ink and the atmospheric pressure may be arranged in the middle of the channel 6*a* or the reservoir TK. The height of the reservoir TK and the height of the printhead 30 in the Z direction may be designed so that the ink liquid surface in the reservoir TK will be at a position lower than the ink discharge surface of the printhead 30.

<Conveyance Apparatus>

The conveyance apparatus 1B is an apparatus that feeds the print medium P to the transfer unit 4 and discharges, from the transfer unit 4, the printed product P' onto which an ink image has been transferred. The conveyance apparatus 1B includes a feeding unit 7, a plurality of conveyance drums 8 and 8*a*, two sprockets 8*b*, a chain 8*c*, and a collection unit 8*d*. In FIG. 1, each of the arrows inside the respective drawings of the components of the conveyance apparatus 1B indicates the rotational direction corresponding to the component, and each of the arrows outside the respective components indicates the conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as the upstream side of the conveyance direction, and the side of the collection unit 8*d* may be referred to as the downstream side of the conveyance direction.

The feeding unit 7 includes a stacking unit for stacking a plurality of print media P and a feeding mechanism for feeding the print medium P sheet by sheet from the stacking unit to the most upstream conveyance drum 8. Each of the conveyance drums 8 and 8*a* is a rotating member that rotates about the rotational axis in the Y direction, and each drum has a cylindrical outer peripheral surface. At least one gripping mechanism for holding the leading edge portion of the print medium P (or the printed product P') is arranged on the outer peripheral surface of each of the conveyance drums 8 and 8*a*. The gripping operation and the releasing operation of each gripping mechanism are controlled so that the print medium P will be passed between adjacent conveyance drums.

The two conveyance drums 8*a* are conveyance drums for reversing the print medium P. When double-sided printing is to be performed on the print medium P, after the ink image has been transferred to the obverse surface, the print medium P is passed to the conveyance drum 8*a* instead of being passed to the adjacent conveyance drum 8 on the downstream side from the pressurizing drum 42. The print medium P is reversed via the two conveyance drums 8*a*, and is passed again to the pressurizing drum 42 via the conveyance drum 8 on the upstream side of the pressurizing drum 42. As a result, the reverse surface of the print medium P will face the transfer drum 41, and an ink image will be transferred to the reverse surface.

The chain 8*c* is wound between two sprockets 8*b*. One of the two sprockets 8*b* is a driving sprocket, and the other is the driven sprocket. The chain 8*c* runs cyclically by the rotation of the driving sprocket. A plurality of gripping mechanisms are arranged spaced apart from each other in the longitudinal direction of the chain 8*c*. Each gripping mechanism grips the edge of the printed product P'. The printed product P' is passed from the communication conveyance drum 8 positioned on the downstream end to the gripping mechanisms of the chain 8*c*, and the printed product P' gripped by the gripping mechanism is conveyed to the collection unit 8*d* by the travel of the chain 8*c*, and the grip is released. As a result, the printed product P' is stacked in the collection unit 8*d*.

<Post-Processing Units>

Post-processing units 10A and 10B are arranged in the conveyance apparatus 1B. The post-processing units 10A and 10B are arranged on the side closer to the downstream side than the transfer unit 4 and are mechanisms for performing post-processing on the printed product P'. The post-processing unit 10A processes the obverse surface of the printed product P', and the post-processing unit 10B processes the reverse surface of the printed product P'. The contents of each process can be, for example, coating the image printed surface of the printed product P' for the purpose of protecting the image, creating gloss, or the like. The contents of a coating operation may be, for example, application of a liquid, adhesion of a sheet, lamination, or the like.

<Inspection Unit>

Inspection units 9A and 9B are arranged in the conveyance apparatus 1B. The inspection units 9A and 9B are arranged closer to the downstream side than the transfer unit 4, and are mechanisms for inspecting the printed product P.

In this embodiment, the inspection unit 9A is an image capturing apparatus that captures an image printed on the printed product P', and includes, for example, an image capturing element such as a CCD sensor, a CMOS sensor, or the like. The inspection unit 9A captures the printed image during a continuous printing operation. Temporal changes in the tint of the colors of the printed image can be confirmed based on an image captured by the inspection unit 9A to determine whether correction of the image data or the print data is required. In this embodiment, the image capturing range of the inspection unit 9A is set to the outer peripheral surface of the pressurizing drum 42, and the inspection unit 9A is arranged so that a printed image can be partially captured immediately after the transfer of the image. The inspection unit 9A may inspect all of the printed images or may inspect a printed image every predetermined number of printed images.

In this embodiment, the inspection unit 9B is also an image capturing apparatus that captures an image printed on the printed product I", and includes, for example, an image capturing element such as a CCD sensor, a CMOS sensor, or the like. The inspection unit 9B captures a printed image in a test printing operation. The inspection unit 9B can capture the overall printed image and set basic settings of various kinds of correction processing related to the print data based on the image captured by the inspection unit 9B. In this embodiment, the inspection unit 9B is arranged at a position for capturing the printed product P' that is conveyed by the chain 8*c*. When the inspection unit 9B is to capture the printed image, the travel of the chain 8*c* is temporarily stopped to capture the entire printed image. The inspection unit 9B may also be a scanner that scans above the printed product P'.

<Control Unit>

Figure 4:
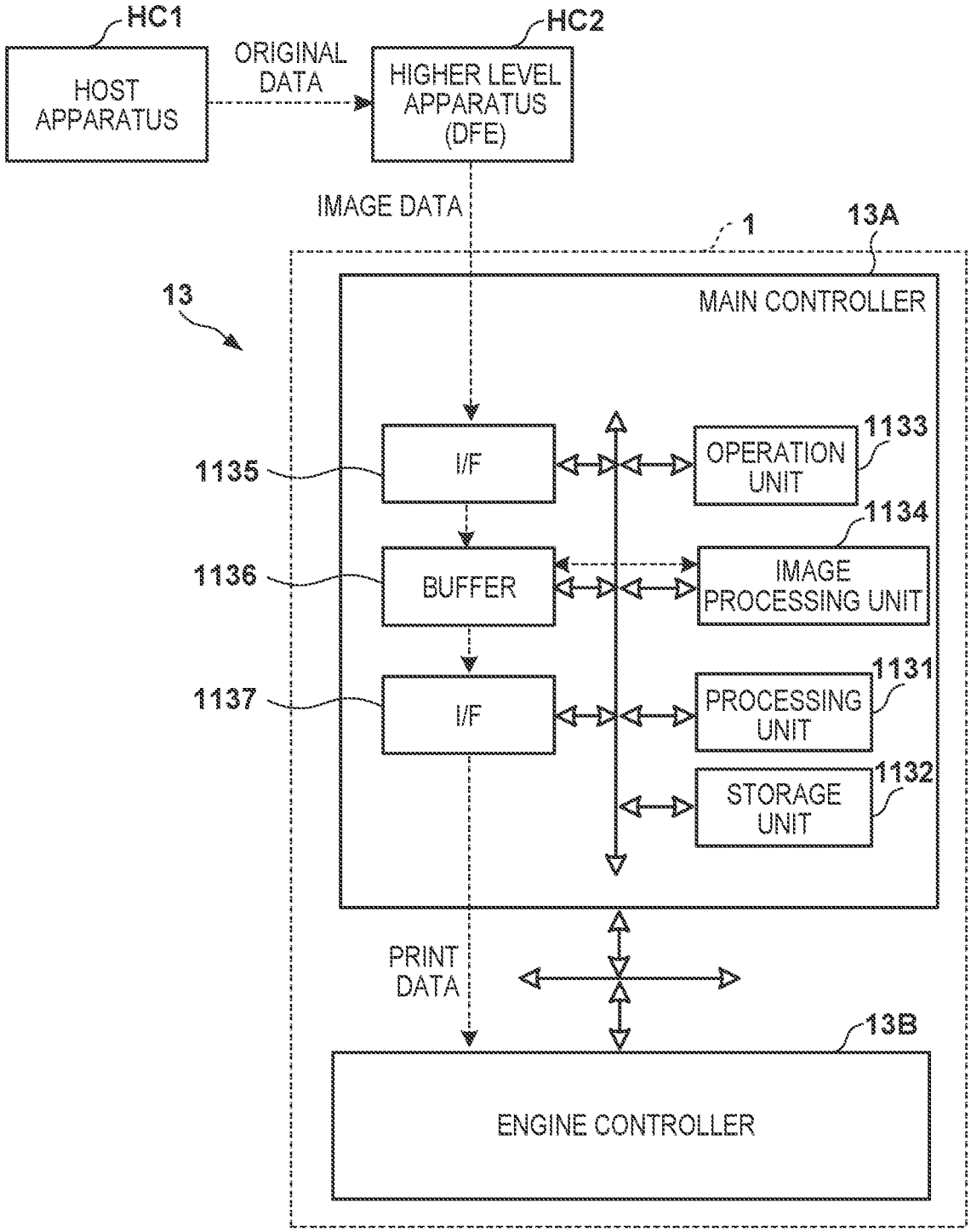
FIG. 4 is a block diagram showing a control system of the printing system of FIG. 1.
Figure 5:
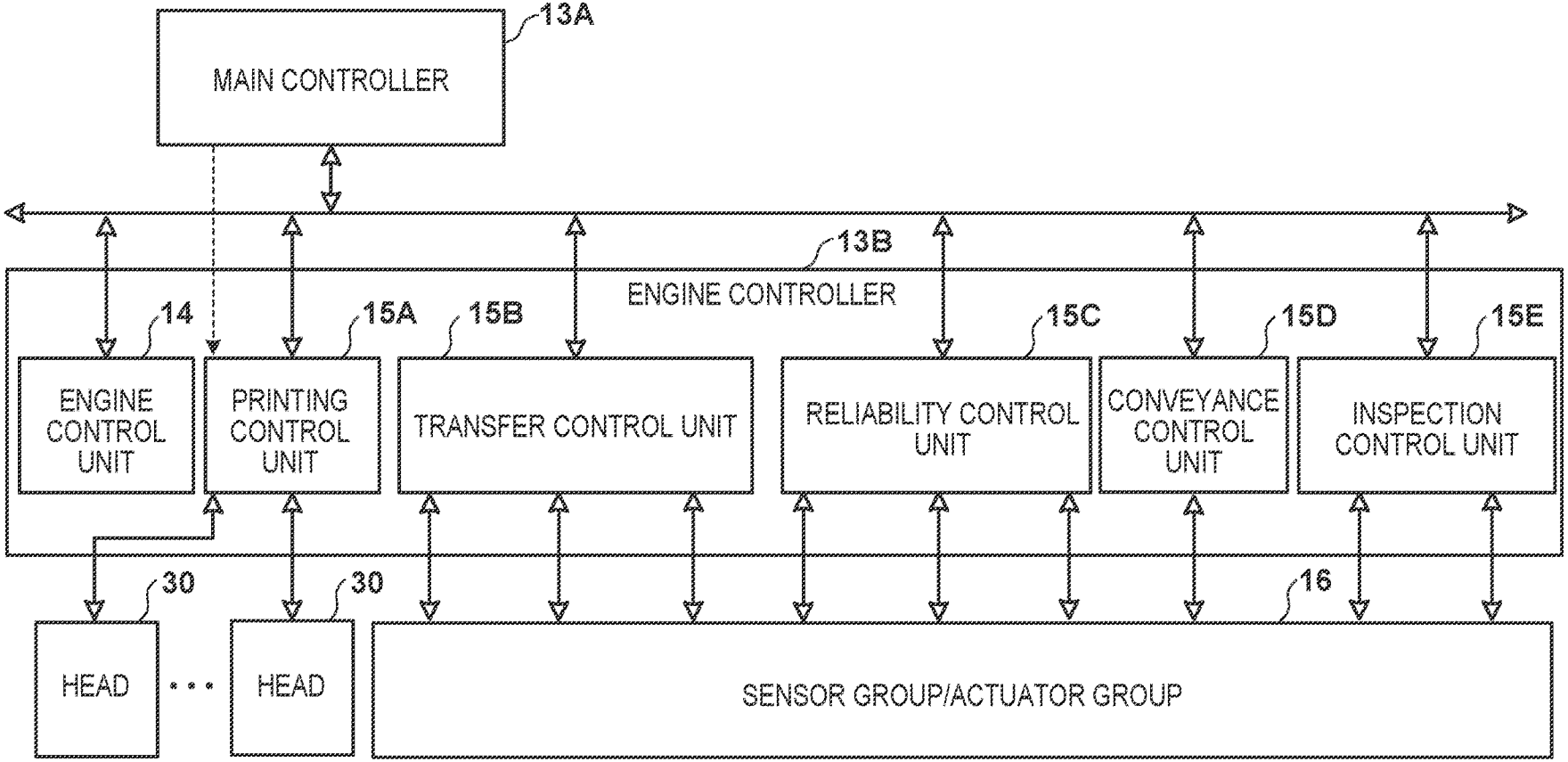
FIG. 5 is a block diagram showing the control system of the printing system of FIG. 1.

The control unit of the printing system 1 will be described next. FIGS. 4 and 5 are block diagrams of a control unit 13 of the printing system 1. The control unit 13 is communicably connected to a higher level apparatus (DFE) HC2, and the higher level apparatus HC2 is communicably connected to a host apparatus HC1.

The host apparatus HC1 generates or stores original data to be the source of a printed image. The original data here is generated, for example, in an electronic file format such as a document file, an image file, or the like. This original data is transmitted to the higher level apparatus HC2, and the higher level apparatus HC2 converts the received original data into a data of a format (for example, RGB data which represents an image by RGB values) that can be used by the control unit 13. The converted data is transmitted as image data from the higher level apparatus HC2 to the control unit 13, and the control unit 13 will start the printing operation based on the received image data.

In this embodiment, the control unit 13 can be largely separated into a main controller 13A and an engine controller 13B. The main controller 13A includes a processing unit 1131, a storage unit 1132, an operation unit 1133, an image processing unit 1134, a communication I/F (interface) 1135, a buffer 1136, and a communication I/F 1137.

The processing unit 1131 is a processor such as a CPU or the like, and controls the overall main controller 13A by executing programs stored in the storage unit 1132. The storage unit 1132 is a storage device such as a RAM, a ROM, a hard disk, an SSD, or the like, stores data and programs to be executed by the CPU 1131, and provides a work area to the CPU 1131. The operation unit 1133 is an input device such as a touch panel, a keyboard, a mouse, or the like, and accepts an instruction from the user.

The image processing unit 1134 is an electronic circuit that includes, for example, an image processing processor. The buffer 1136 is, for example, a RAM, a hard disk, or an SSD. The communication I/F 1135 communicates with the higher level apparatus HC2, and the communication I/F 1137 communicates with the engine controller 13B. In FIG. 4, a broken line arrow exemplifies the flow of the processing of image data. The image data received from the higher level apparatus HC2 via the communication I/F 1135 is accumulated in the buffer 1136. The image processing unit 1134 reads out the image data from the buffer 1136, performs predetermined image processing on the image data that has been read out, and stores the processed image data again in the buffer 1136. The image data that has undergone the image processing and is stored in the buffer 1136 is transmitted, as print data to be used by the print engine, from the communication I/F 1137 to the engine controller 13B.

As shown in FIG. 5, the engine controller 13B includes control units 14 and 15A to 15E, obtains detection results from a sensor group/actuator group 16 included in the printing system 1, and performs driving control. Each of these control units includes a processor such as a CPU, a storage device such as a RAM, a ROM, or the like, and an interface to an external device. Note that the divisions of the control units are merely an example, and some of the control operations may be executed by a plurality of control units that have been further subdivided. On the other hand, it may also be arranged so that the plurality of control units will be integrated and a single control unit will perform the control contents of these control units.

The engine control unit 14 controls the overall engine controller 13B. The printing control unit 15A converts the print data received from the main controller 13A into data, such as raster data or the like, of a format suitable for driving the printheads 30. The printing control unit 15A controls the discharge operation of each printhead 30.

The transfer control unit 15B controls the application unit 5A, the absorption unit 5B, the heating unit 5C, and the cleaning unit 5D.

The reliability control unit 15C controls the supply unit 6, the recovery unit 12, and a driving mechanism for moving the print unit 3 between the discharge position POS1 and the recovery position POS3.

The conveyance control unit 15D performs driving control of the transfer unit 4 and controls the conveyance apparatus 1B. The inspection control unit 15E controls the inspection unit 9B and the inspection unit 9A.

In the sensor group/actuator group 16, a sensor for detecting the position and speed of each movable portion, a sensor for detecting the temperature, an image capturing sensor, and the like are included in the sensor group. A motor, an electromagnetic solenoid, an electromagnetic valve, and the like are included in the actuator group.

Operation Example

Figure 6:
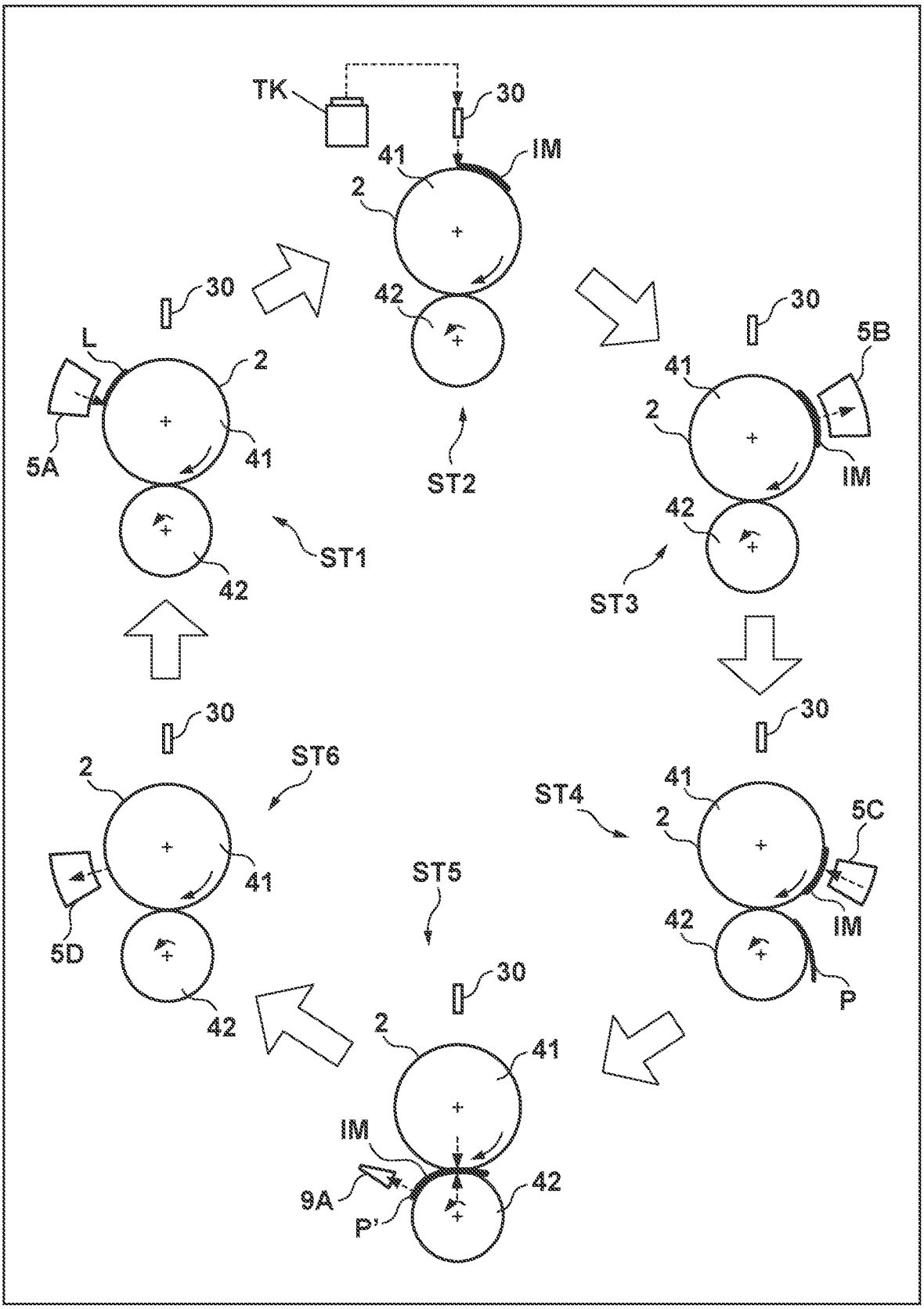
FIG. 6 is an explanatory view showing an example of the operation of the printing system of FIG. 1.

FIG. 6 is a view schematically showing an example of a printing operation. The following processes are cyclically performed while the transfer drum 41 and the pressurizing drum 42 are rotated. As shown in a state ST1, first, a reaction liquid L is applied from the application unit 5A onto the transfer member 2. The portion of the transfer member 2 on which the reaction liquid L has been applied moves in accordance with the rotation of the transfer drum 41. When the portion on which the reaction liquid L has been applied has reached below the printhead 30, ink is discharged from the printhead 30 to the transfer member 2 as shown in a state ST2. An ink image IM is formed as a result. At this time, the coagulation of coloring materials is promoted by the mixing of the discharged ink and the reaction liquid L on the transfer member 2. The discharged ink is supplied from the reservoir TK of the supply unit 6 to the printhead 30.

The ink image IM on the transfer member 2 moves in accordance with the rotation of the transfer member 2. When the ink image IM has reached the absorption unit 5B, the absorption unit 5B sucks the liquid component from the ink image IM as shown in a state ST3. When the ink image IM has reached the heating unit 5C, the heating unit 5C heats the ink image IM as shown in a state ST4, thus melting the resin in the ink image IM and forming the ink image IM into a film. The print medium P is conveyed by the conveyance apparatus 1B in synchronization with the formation of the ink image IM in this manner.

As shown in a state ST5, when the ink image IM and the print medium P have reached the nip portion of the transfer member 2 and the pressurizing drum 42, the ink image IM is transferred to the print medium P, thereby producing the printed product P'. When the printed product P' passes through the nip portion, the inspection unit 9A captures the image printed on the printed product P' and inspects the printed image. The printed product P is conveyed by the conveyance apparatus 1B to the collection unit 8*d*.

When the portion where the ink image IM is formed on the transfer member 2 has reached the cleaning unit 5D, the cleaning unit 5D will clean the portion as shown in a state ST6. The completion of the cleaning corresponds to the fact that the transfer member 2 has completed one rotation, and the transfer of an ink image to the print medium P is repeatedly performed according to a similar procedure. Although a case in which one transfer operation of the ink image IM to one sheet of print medium P is performed by one rotation of the transfer member 2 has been described above for the sake of descriptive convenience, the ink image IM can be continuously transferred to a plurality of sheets of print media P by one rotation of the transfer member 2.

Figure 7:
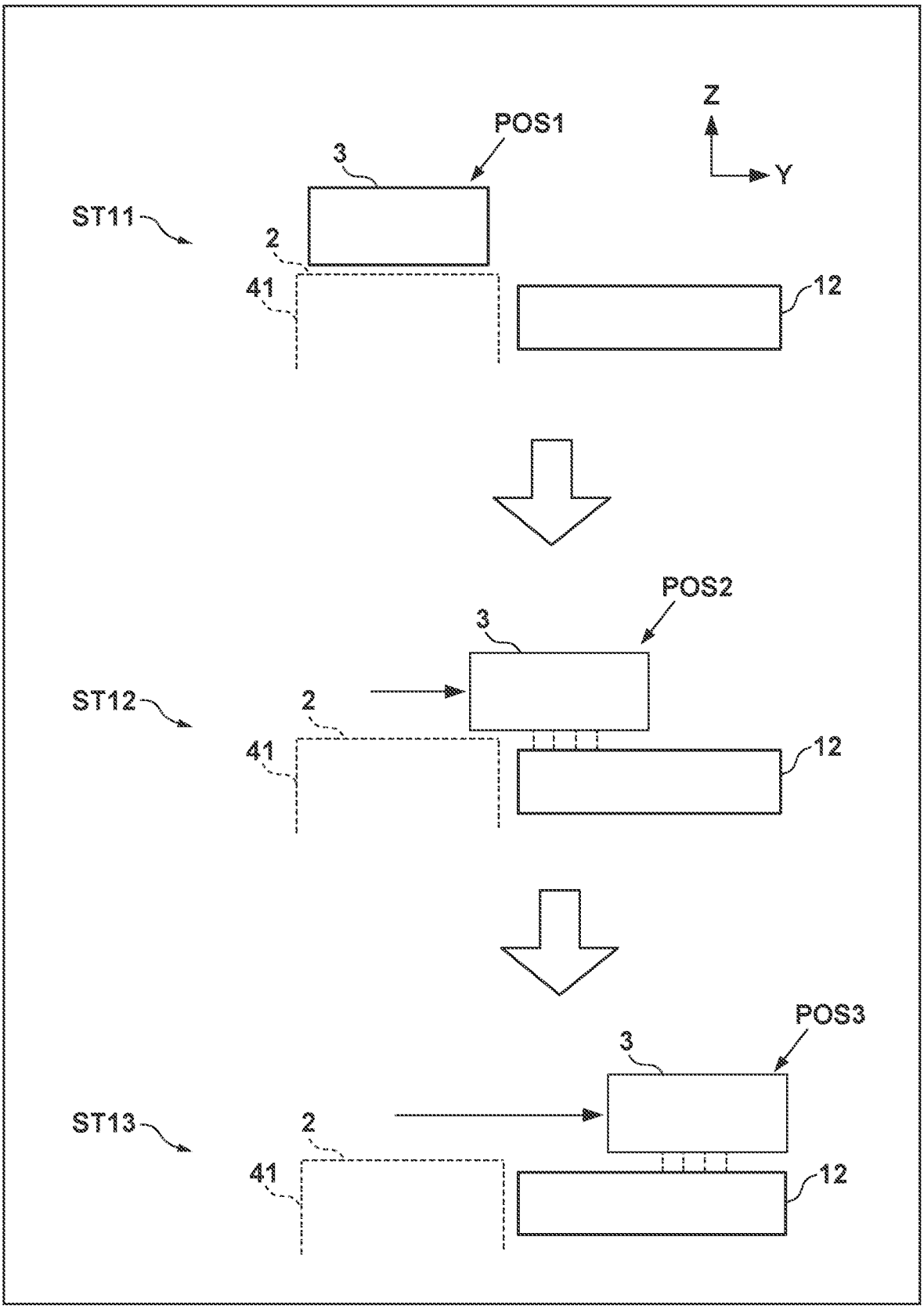
FIG. 7 is an explanatory view showing an example of the operation of the printing system of FIG. 1.

Maintenance of the printheads 30 will be required when such a printing operation is continued. FIG. 7 shows an example of the operation performed during the maintenance of each printhead 30. A state ST11 shows a state in which the print unit 3 is positioned at the discharge position POS1. A state ST12 shows a state in which the print unit 3 passes through the preliminary recovery position POS2, and a process for recovering the discharge performance of each printhead 30 of the print unit 3 is executed by the recovery unit 12 during this passage. Subsequently, as shown in a state ST13, the recovery unit 12 executes the process for recovering the discharge performance of each printhead 30 in a state in which the print unit 3 is positioned at the recovery position POS3.

<Heating Unit>

A more specific example of the heating unit 5C will be described. The heating unit 5C is an apparatus has been arranged in a fixed position so as to radiate heat to the transfer member 2 at a predetermined position (to be referred to as a heating position) in the circumferential direction of the transfer drum 41. The ink image can be heated by the heating unit 5C when the ink image passes through the heating position.

Figure 8:
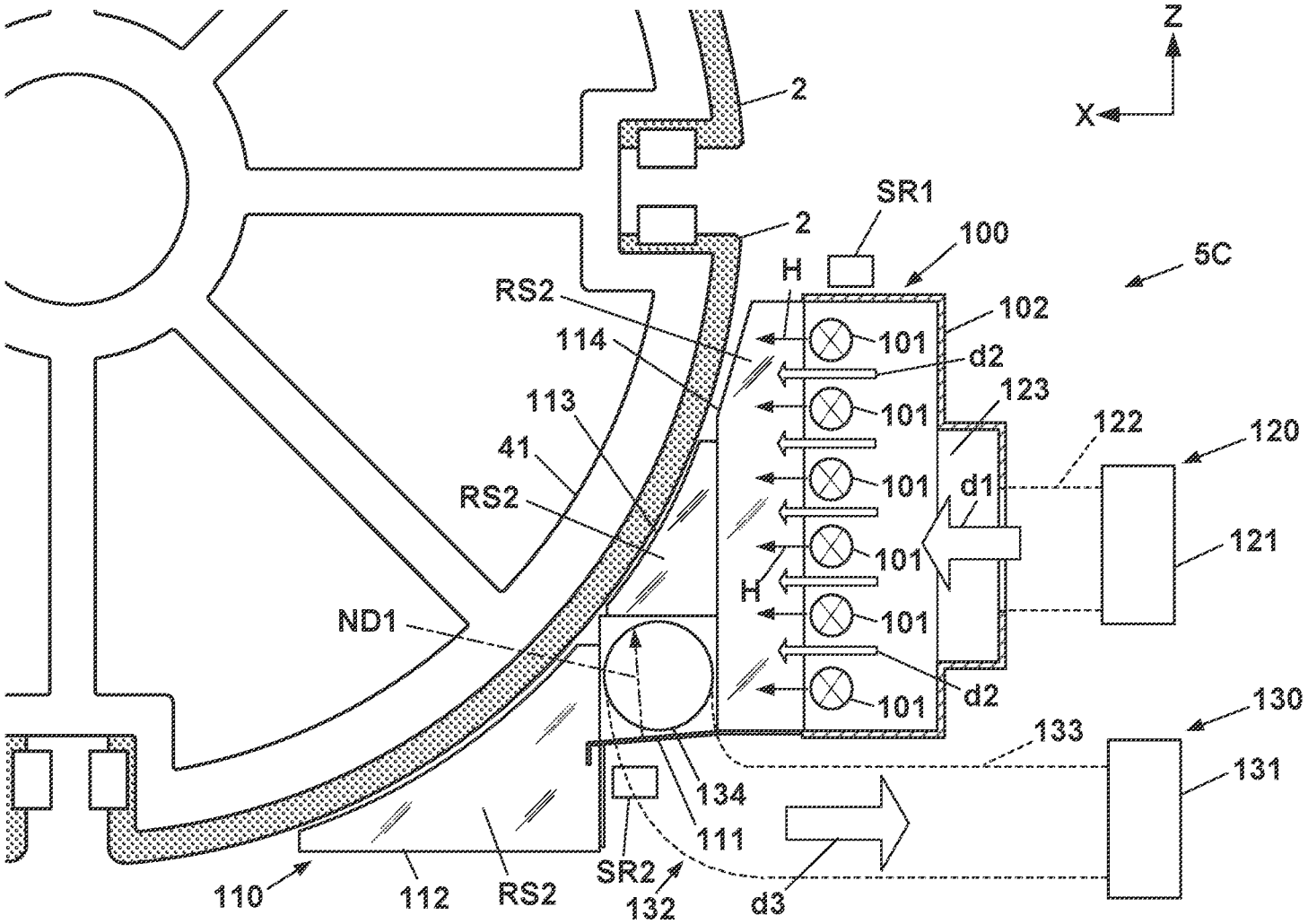
FIG. 8 is an explanatory view of a heating unit.
Figure 9:
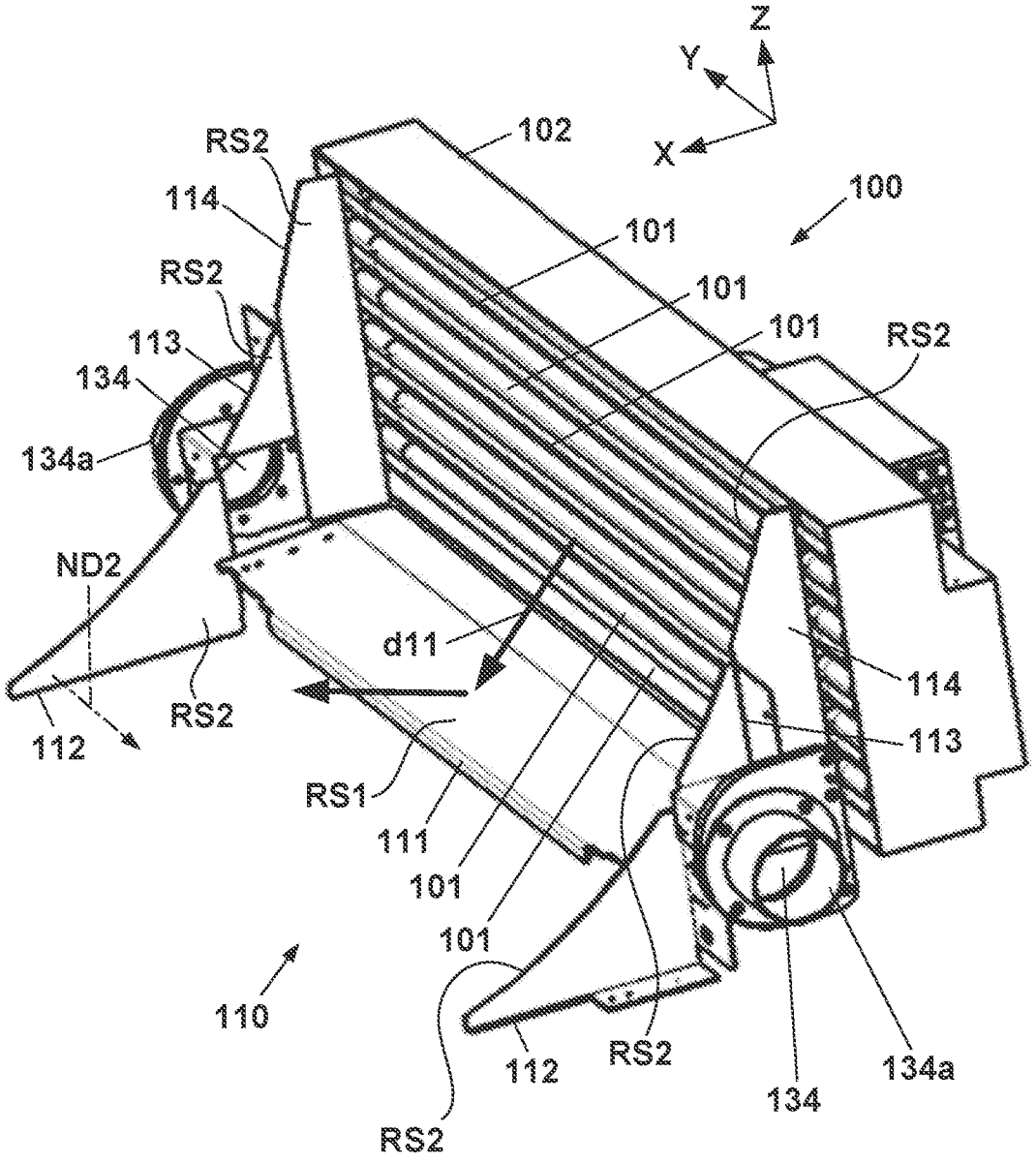
FIG. 9 is a perspective view of a heat generating unit and a reflecting unit of the heating unit.
Figure 10:
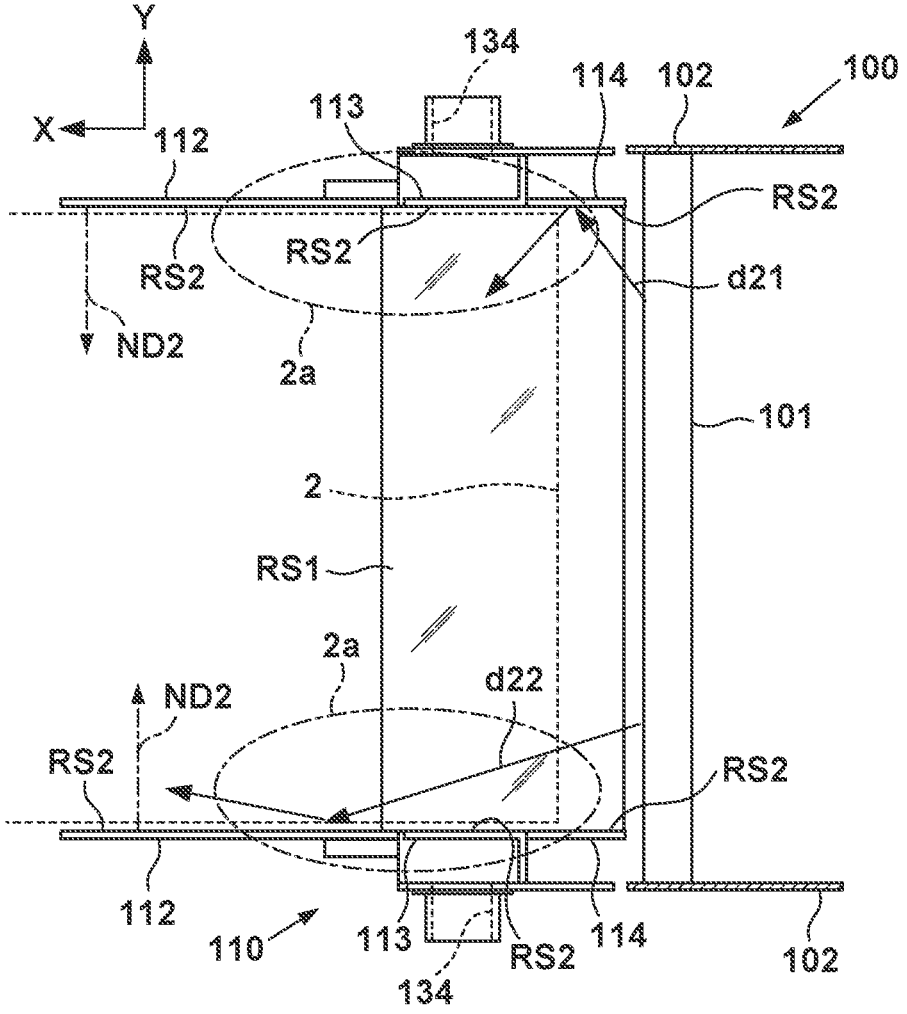
FIG. 10 is a plan view of the heat generating unit and the reflecting unit.

FIG. 8 is an explanatory view (sectional view) of the structure of the heating unit 5C, and is a perspective view of a heat generating unit 100 and a reflecting unit 110. FIG. 9 is a perspective view of the heat generating unit 100 and the reflecting unit 110 which form the heating unit 5C. FIG. 10 is a plan view (a partially sectional view) of the heat generating unit 100 and the reflecting unit 110 seen from above.

The heating unit 5C includes the heat generating unit 100, the reflecting unit 110, a cooling unit 120, a pair of left and right exhaust units 130, and sensors SR1 and SR2.

The heat generating unit 100 includes a plurality of heat generating elements 101 and a housing 102 for containing the plurality of heat generating elements 101. Each of the plurality of heat generating elements 101 is, for example, an infrared lamp heater. Each heat generating element 101 is shaped like a stick and extends in the Y direction. In other words, each heat generating element 101 extends in parallel to the axial direction of the rotation axis of the transfer drum 41, and also extends parallel to the widthwise direction of the transfer member 2. Each heat generating element 101 also has a length that corresponds to the width of the transfer member 2 in the axial direction of the transfer drum 41. The plurality of heat generating elements 101 are arranged in the Z direction, and a gap is provided between adjacent heat generating elements 101 in the Z direction.

The housing 102 is shaped like a box with an opening on its front side (on the side of the transfer drum 41 (the same will be applied hereinafter)), and the plurality of heat generating elements 101 are exposed from this opening. The internal wall surface of the housing 102 may be formed as a mirror surface so that the radiant heat from the heat generating elements 101 will be reflected to the side of the transfer member 2. An air chamber 123 is formed in the housing 102.

The reflecting unit 110 includes a reflecting surface RS1 and a pair of left and right reflecting surfaces RS2 for reflecting the radiant heat from the heat generating elements 101. The reflecting surface RS1 is formed by a reflecting member 111, and each of the reflecting surfaces RS2 is formed by pairs of left and right reflecting members 112 to 114. Each of the reflecting members 111 to 114 is a stainless steel plate, and a mirror finish process can be performed on the surfaces of these members to form the reflecting surface RS1 and the reflecting surfaces RS2.

On the lower front side of the heat generating unit 100, the reflecting member 111 extends from the side of the heat generating unit 100 to the side of the transfer drum 41 (the side of the transfer member 2) while also extending in the Y direction, and is supported overall in a horizontal posture. The reflecting surface RS1 is a flat surface formed on the upper surface of the reflecting member 111. The reflecting surface RS1 extends in the Y direction and the X direction, and is a horizontal surface parallel to the Y direction. In this embodiment, a portion on the front side of the reflecting surface RS1 is slightly tilted downward toward the side of the transfer drum 41 (see FIG. 8).

The reflecting surface RS1 is formed so that its normal direction ND1 (FIG. 8) will intersect with the transfer member 2. As indicated by an arrow d11 in FIG. 9, the reflecting surface RS1 reflects radiant heat, of the radiant heat emitted from the heat generating elements 101, which is emitted toward the front side in a downward direction to the transfer member 2. Although the reflecting surface RS1 is a flat surface in this embodiment, it may be a curved surface. In such case, at least a portion of the normal direction may intersect with the transfer member 2 as shown by the normal direction ND1 in FIG. 8. In addition, a reflecting surface similar to the reflecting surface RS1 may be arranged on the upper front side of the heat generating unit 100.

On the front side of each of the one end and the other end of the heat generating unit 100 in the Y direction, the reflecting members 112 to 114 extend from the side of the heat generating unit 100 to the side of the transfer drum 41 (the side of the transfer member 2) while also extending in the Z direction, and are supported overall in a vertical posture. Each reflecting surface RS2 is a flat surface formed on an inner surface (a side surface on the side of the reflecting member 111) of each of the reflecting members 112 to 114. Although each reflecting surface RS2 is formed by the plurality of reflecting members 112 to 114, it can also be formed by a single reflecting member. Each reflecting surface RS2 extends in the X direction and the Y direction, and is a surface that intersects with the Y direction. Although each reflecting surface RS2 is a vertical surface that is perpendicular to the Y direction in this embodiment, the angle of intersection with the Y direction may be other than 90° and may be, for example, an angle that falls within a range of 70° to 110°.

The front-side portion of each of the reflecting members 112 to 114 and the reflecting surfaces RS2 is formed to have an arc shape along the contour of the transfer drum 41 (see FIG. 8). As a result, the heat generating elements 101 can be arranged near the transfer drum 41 while avoiding a state in which the area of each reflecting surface RS2 becomes unnecessarily large.

Each reflecting surface RS2 is formed so that its normal direction ND2 (FIGS. 9 and 10) will be parallel to the Y direction. As indicated by arrows d21 and d22 in FIG. 10, each reflecting surface RS2 reflects radiant heat, of the radiant heat emitted from the heat generating elements 101, which is emitted outside in the Y direction toward the transfer member 2. As a result, it will be possible to reduce the variation in the degree of heating by the radiant heat between a central region and edge regions 2*a* in the Y direction of the transfer member 2, and heating can be performed uniformly on the transfer member 2 in the Y direction. That is, the ink image on the transfer member 2 can be heated substantially uniformly.

Although each reflecting surface RS2 is a flat surface in this embodiment, it may be a curved surface. In also such a case, at least a portion of the normal direction may be parallel to the Y direction as shown by the normal direction ND2 in FIG. 10.

In this embodiment, the reflecting surface RS2 is arranged on each of both ends of the reflecting surface RS1 in the Y direction. Hence, the space between the transfer member 2 and the heat generating elements 101 is a space (to be sometimes referred to as the inner space of the reflecting unit 110) surrounded by the reflecting surface RS1 and the reflecting surfaces RS2, and the radiant heat emitted by the heat generating elements 101 will be reflected three-dimensionally from multiple directions to the side of the transfer member 2. As a result, the radiant heat from the heat generating elements 101 can be thoroughly applied to the ink image, and heating can be performed efficiently by using fewer heat generating elements 101.

The cooling unit 120 is an air cooling unit for cooling the reflecting surfaces RS1 and RS2 by directly supplying gas to the reflecting surfaces RS1 and RS2. When the reflecting surfaces RS1 and RS2 are exposed to a high temperature by the radiant heat of the heat generating elements 101 for a long time, the reflection efficiency may degrade due to whitening. Cooling the reflecting surfaces RS1 and RS2 will allow such degradation to be suppressed.

The cooling unit 120 includes a supply source 121 and a duct 122. The supply source 121 is, for example, a compressor. Air is used as the gas in this embodiment. Air is, for example, the surrounding atmosphere of the printing system 1, and is room temperature air. The duct 122 connects the supply source 121 and the housing 102. An opening is provided on the rear portion of the housing 102, and the duct 122 is connected to this opening. The air supplied under pressure from the supply source 121 is supplied to the air chamber 123 of the housing 102 via the duct 122 as indicated by an arrow d1 in FIG. 8. The air supplied under pressure to the air chamber 123 is blown from the gaps between adjacent heat generating elements 101 to the inner space of the reflecting unit 110 as indicated by an arrow d2. As a result, air is directly supplied to the reflecting surfaces RS1 and RS2, and the reflecting surfaces RS1 and RS2 are cooled by this air current.

In this embodiment, the reflecting surfaces RS1 and RS2 can be cooled comparatively simply and at a low cost by the air cooling method. Although any kind of route may be adopted as the gas supply route, blowing gas from the side of the heat generating elements 101 in the manner of this embodiment will allow the reflecting surfaces RS1 and RS2 to be cooled by supplying gas comparatively thoroughly to the reflecting surfaces RS1 and RS2. This is because the reflecting surfaces RS1 and RS2 are arranged so as to reflect the radiant heat from the heat generating elements 101 and the blow out direction of the gas is close to the heat radiation direction of the heat generating elements 101.

Each exhaust unit 130 is a unit for exhausting gas supplied to the reflecting surfaces RS1 and RS2, and exhausts air from the inner space of the reflecting unit 110. As a result, the air current flowing on the reflecting surfaces RS1 and RS2 can be promoted to improve the cooling performance of the reflecting surfaces RS1 and RS2.

Each exhaust unit 130 includes a suction source 131 and an exhaust path 132 which communicates to the inner space of the reflecting unit 110. The suction source 131 is, for example, a pump, and forcefully exhausts air of the inner space of the reflecting unit 110 to the outside via the exhaust path 132 as shown by an arrow d3 in FIG. 8. Note that one processing unit 131 may be shared between the pair of left and right exhaust units 130.

The exhaust path 132 includes a duct 133 and an exhaust port 134 to which the duct 133 is connected. The exhaust port 134 has, by tube members 134*a*, respective openings formed in one end and the other end in the Y direction of the reflecting surface RS1, and faces the inner space of the reflecting unit 110. In this embodiment, each reflecting surface RS2 is arranged so as to surround the corresponding exhaust port 134 on the X-Y plane. Since the air current that flows to the exhaust port 134 is promoted in the periphery of the exhaust port 134, the cooling performance of the reflecting surface RS2 can be improved.

Figure 11:
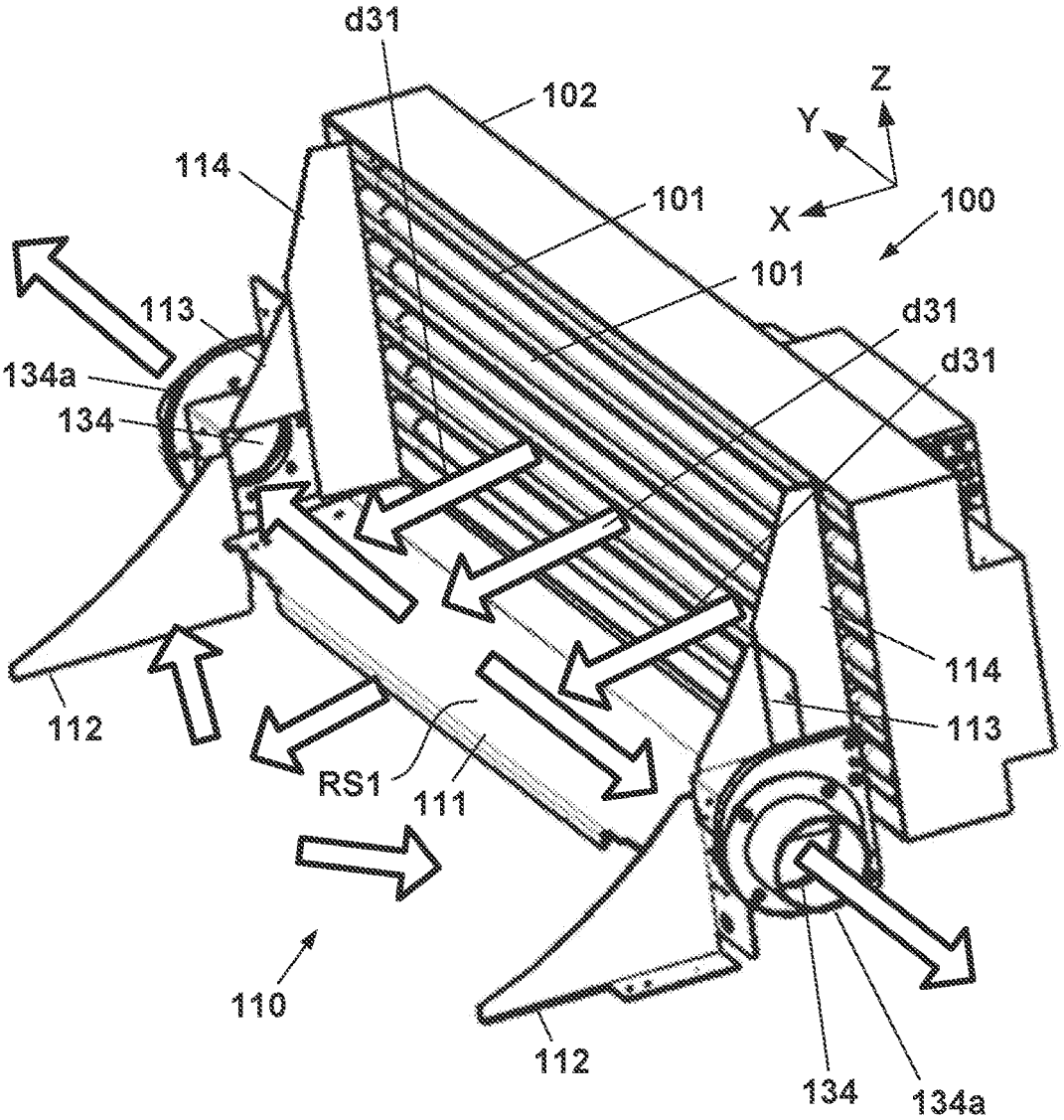
FIG. 11 is an explanatory view of an air current.

In this embodiment, the gas from the cooling unit 120 is blown from the vicinity of the heat generating elements 101 toward the transfer member 2 in the X direction, and an exhaust operation by the exhaust unit 130 is performed from above the reflecting surface RS1 in both directions of the Y direction. Hence, the flow of the air current in the inner region of the reflecting unit 110 will generate a T-shaped or Y-shaped air current because the supplied air current and the exhausted air current will be perpendicular to each other on the reflecting surface RS1 as shown by arrows in FIG. 11. As a result, a state in which the air current will become stagnant in the inner space of the reflecting unit 110 can be suppressed, and the gas can be circulated smoothly.

Note that although exhaust is performed forcefully by using the suction source 131 in this embodiment, exhaust may be performed naturally without using the suction source 131. In such a case, an arrangement which includes only the exhaust ports 134 or an arrangement which includes the exhaust ports 134 and the duct 133 can be adopted.

In this embodiment, each of the sensors SR1 and SR2 is a temperature/humidity sensor that detects both the temperature and the humidity. The temperature and the humidity in the inner region of the reflecting unit 110 are estimated based on the temperature and the humidity near the heating unit 5C, and the driving of one of the heat generating unit 100, the cooling unit 120, and the exhaust unit 130 is controlled to heat the ink image appropriately.

For example, the resin in the ink image may melt insufficiently if the ink image is heated weakly. On the other hand, the liquid component may be absorbed insufficiently from the ink image by the absorption unit 5B if the ink image is heated strongly. In addition, for example, the ink image may become too dry and the transfer of the image may be performed insufficiently if the surrounding humidity of the ink image is low, and the transferred ink image may bleed if the humidity is high.

In this embodiment, the sensors SR1 and SR2 are arranged at different positions. The sensor SR1 is arranged on the upper portion of the heating unit 5C, and the sensor SR2 is arranged on the lower portion of the heating unit 5C. By arranging the sensors SR1 and SR2 at different positions and using the respective detection results from these sensors, the estimation accuracy of the temperature and the humidity in the inner region of the reflecting unit 110 can be improved. For example, the average values of the detection results of the sensors SR1 and SR2 can be assumed to be the temperature and the humidity of the inner region of the reflecting unit 110 and be set as the final temperature and humidity detection results to be referred to for executing control.

Note that although two sensors SR1 and SR2 are arranged in this embodiment, three or more sensors may be provided. In addition, although each of the sensors SR1 and SR2 detects both the temperature and the humidity, only a temperature sensor or a humidity sensor may be arranged, and it may be arranged so that control will be performed by referring to only the temperature or the humidity.

Figure 12:
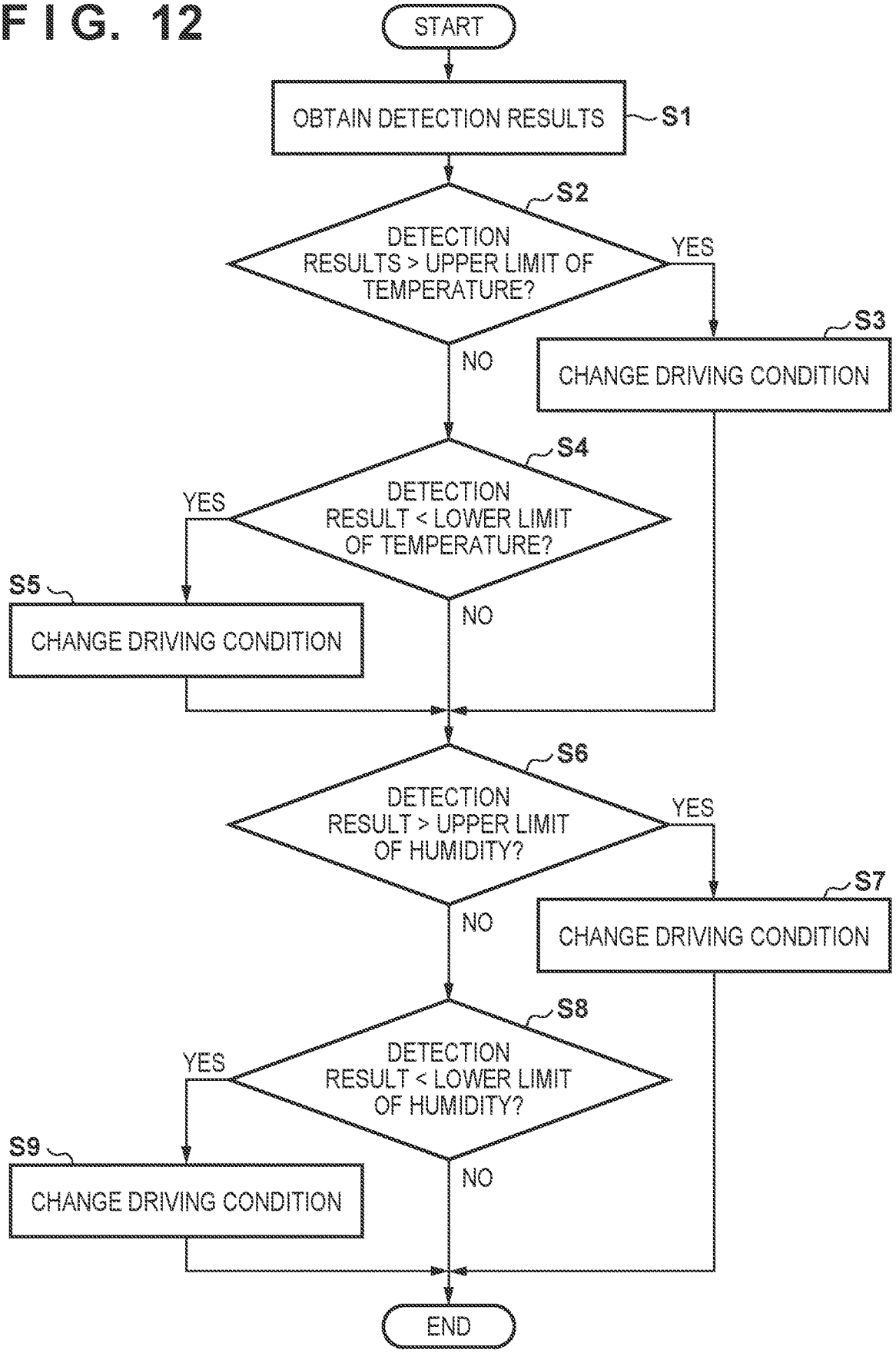
FIG. 12 is a flowchart showing an example of control.

FIG. 12 shows an example of control performed on the heat generating unit 100, the cooling unit 120, or the exhaust unit 130 by using the detection results of the sensors SR1 and SR2. This processing is executed by, for example, the transfer control unit 15B.

In step S1, the detection results of the sensors SR1 and SR2 are obtained. For example, the average value of the temperature and the average value of the humidity can be calculated from the obtained detection results. In step S2, whether the temperature calculated in step S1 exceeds a predetermined upper limit value is determined. If the calculated temperature exceeds the predetermined upper limit value, the process advances to step S3. Otherwise, the process advances to step S4. In step S3, the driving condition of one of the heat generating unit 100, the cooling unit 120, or the exhaust unit 130 is changed to reduce the temperature. For example, the output of the heat generating unit 100 is reduced. Alternatively, for example, the circulation of the air current is promoted by increasing the amount of gas supplied under pressure from the cooling unit 120 and the exhaust amount of the exhaust unit 130.

In step S4, whether the temperature calculated in step S1 is below a predetermined lower limit value is determined. If the calculated temperature is below the predetermined lower limit value, the process advances to step S5. Otherwise, the process advances to step S6. In step S5, the driving condition of one of the heat generating unit 100, the cooling unit 120, or the exhaust unit 130 is changed to increase the temperature. For example, the output of the heat generating unit 100 is increased. Alternatively, for example, the circulation of the air current is suppressed by reducing the amount of gas supplied under pressure from the cooling unit 120 and the exhaust amount of the exhaust unit 130. Such control can be performed to maintain a constant temperature in the inner region of the reflecting unit 110.

In step S6, whether the humidity calculated in step S1 exceeds a predetermined upper limit value is determined. If the calculated humidity exceeds the predetermined upper limit value, the process advances to step S7. Otherwise, the process advances to step S8. In step S7, the driving condition of one of the heat generating unit 100, the cooling unit 120, or the exhaust unit 130 is changed to reduce the humidity. For example, the output of the heat generating unit 100 is increased. Alternatively, for example, the circulation of the air current is promoted by increasing the amount of gas supplied under pressure from the cooling unit 120 and the exhaust amount of the exhaust unit 130.

In step S8, whether the humidity calculated in step S1 is below a predetermined lower limit value is determined. If the calculated humidity is below the predetermined lower limit value, the process advances to step S9. Otherwise, the processing ends. In step S9, the driving condition of one of the heat generating unit 100, the cooling unit 120, or the exhaust unit 130 is changed to increase the humidity. For example, the output of the heat generating unit 100 is reduced. Alternatively, for example, the circulation of the air current is suppressed by reducing the amount of gas supplied under pressure from the cooling unit 120 and the exhaust amount of the exhaust unit 130. Such control can be performed to maintain a constant humidity in the inner region of the reflecting unit 110.

According to the present invention, a technique for suppressing the degradation of a reflecting surface that reflects radiant heat can be provided.

OTHER EMBODIMENTS

Figure 13:
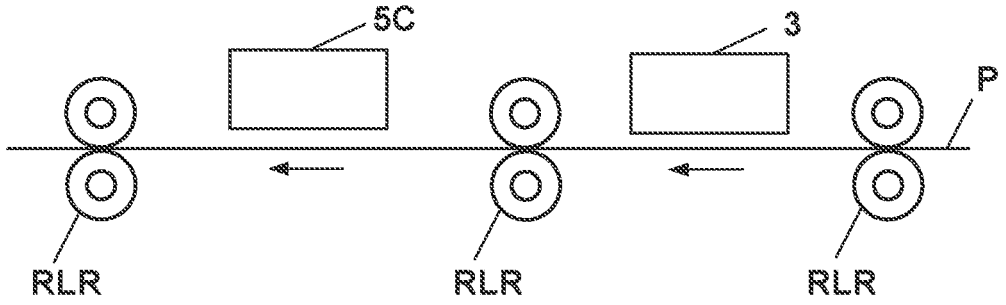
FIG. 13 is a schematic view of a printing system according to another example.

Although the transfer member 2 is used as a medium on which the ink image is formed by the print unit 3 in the above-described embodiment, it may be arranged so that the print medium P will be the medium on which the ink image is formed and the ink image may be heated by the heating unit 5C. FIG. 13 is an explanatory view illustrating such an example. In example of FIG. 13, the print medium P is conveyed by the plurality of pairs of rollers RLR. An ink image is formed by causing the print unit 3 to discharge ink onto the print medium P during the conveyance process of the print medium P. Subsequently, the ink image is heated by the heating unit 5C. In this case, the heating operation is mainly performed for the purpose of drying the ink image (image) quickly.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A printing apparatus comprising:

a printing unit configured to form an image by discharging liquid onto a medium, and a heating unit configured to heat the image on the medium, wherein the heating unit includes:

a heat generating unit configured to generate radiant heat, a reflecting unit that includes a reflecting surface configured to reflect the radiant heat of the heat generating unit, a cooling unit configured to cool the reflecting surface by supplying air to the reflecting surface, an exhaust passage configured to exhaust the air supplied to the reflecting surface, and a suction unit configured to suck the air via the exhaust passage.

2. The printing apparatus according to claim 1, wherein the reflecting surface includes:

a portion whose normal direction intersects with the medium, and a portion whose normal direction is parallel to a widthwise direction of the medium.

3. The printing apparatus according to claim 1, wherein the heat generating unit is configured to extend parallel to the widthwise direction of the medium, and the reflecting surface includes:

a first reflecting surface which extends in the widthwise direction and is parallel to the widthwise direction, and a second reflecting surface which is arranged at both ends in the widthwise direction of the first reflecting surface and intersects with the widthwise direction.

4. The printing apparatus according to claim 1, wherein the exhaust passage includes a first exhaust passage and a second exhaust passage, each of which is configured to exhaust the air supplied to the reflecting surface, the heat generating unit is configured to extend in parallel to a widthwise direction of the medium, the reflecting surface extends in the widthwise direction and includes a first reflecting surface parallel to the widthwise direction, the cooling unit is configured to blow the air from the side of the heat generating unit toward the side of the medium, an exhaust port of the first exhaust passage opens in the widthwise direction at one end of the first reflecting surface in the widthwise direction, and an exhaust port of the second exhaust passage opens in the widthwise direction at the other end of the first reflecting surface in the widthwise direction.

5. The printing apparatus according to claim 4, wherein the reflecting surface includes second reflecting surfaces which are arranged at respective ends of the first reflecting surface in the widthwise direction and intersect with the widthwise direction, the second reflecting surface on the side of the one end of the first reflecting surface is formed to surround the exhaust port of the first exhaust passage, and the second reflecting surface on the side of the other end of the first reflecting surface is formed to surround the exhaust port of the second exhaust passage.

6. The printing apparatus according to claim 1, wherein the heating unit includes a temperature sensor configured to detect a change in temperature due to heating, and the printing apparatus includes a control unit configured to control the heat generating unit and/or the cooling unit based on a detection result of the temperature sensor.

7. The printing apparatus according to claim 6, wherein the heating unit includes an exhaust unit configured to exhaust the air supplied to the reflecting surface, and the control unit controls the heat generating unit, the cooling unit, and/or the exhaust unit based on the detection result of the temperature sensor.

8. The printing apparatus according to claim 1, wherein the heating unit includes a humidity sensor configured to detect a change in humidity due to heating, and the printing apparatus includes a control unit configured to control the heat generating unit and/or the cooling unit based on a detection result of the humidity sensor.

9. The printing apparatus according to claim 8, wherein the heating unit includes an exhaust unit configured to exhaust the air supplied to the reflecting surface, and the control unit controls the heat generating unit, the cooling unit, and/or the exhaust unit based on the detection result of the humidity sensor.

10. The printing apparatus according to claim 1, wherein the medium is a transfer member, and the printing unit transfers an image formed on the transfer member to a print medium.

11. The printing apparatus according to claim 10, wherein the transfer member is supported by a transfer drum, and the heating unit is arranged in the periphery of the transfer drum.

12. The printing apparatus according to claim 11, wherein the heat generating unit is configured to extend parallel to an axial direction of the transfer drum, the reflecting surface includes:

a first reflecting surface which extends in the axial direction and is parallel to the axial direction, and second reflecting surfaces which are arranged at respective ends of the first reflecting surface in the axial direction and intersect with the axial direction, and the second reflecting surface includes a portion formed in an arc shape along a contour of the transfer drum.

13. A heating apparatus that heats an image formed on a medium, comprising:

a heat generating unit configured to generate radiant heat;

a reflecting unit which includes a reflecting surface configured to reflect the radiant heat of the heat generating unit, a cooling unit configured to cool the reflecting surface by supplying air to the reflecting surface, an exhaust passage configured to exhaust the air supplied to the reflecting surface, and a suction unit configured to suck the air via the exhaust passage.

14. The heating apparatus according to claim 13, wherein the reflecting surface includes:

a portion whose normal direction intersects with the medium, and a portion whose normal direction is parallel to a widthwise direction of the medium.

15. The heating apparatus according to claim 13, wherein the heat generating unit is configured to extend parallel to the widthwise direction of the medium, and the reflecting surface includes:

a first reflecting surface which extends in the widthwise direction and is parallel to the widthwise direction, and a second reflecting surface which is arranged at both ends in the widthwise direction of the first reflecting surface and intersects with the widthwise direction.

16. The heating apparatus according to claim 13, wherein the exhaust passage includes a first exhaust passage and a second exhaust passage, each of which is configured to exhaust the air supplied to the reflecting surface, the heat generating unit is configured to extend in parallel to a widthwise direction of the medium, the reflecting surface extends in the widthwise direction and includes a first reflecting surface parallel to the widthwise direction, the cooling unit is configured to blow the air from the side of the heat generating unit toward the side of the medium, an exhaust port of the first exhaust passage opens in the widthwise direction at one end of the first reflecting surface in the widthwise direction, and an exhaust port of the second exhaust passage opens in the widthwise direction at the other end of the first reflecting surface in the widthwise direction.

17. The heating apparatus according to claim 16, wherein the reflecting surface includes second reflecting surfaces which are arranged at respective ends of the first reflecting surface in the widthwise direction and intersect with the widthwise direction, the second reflecting surface on the side of the one end of the first reflecting surface is formed to surround the exhaust port of the first exhaust passage, and the second reflecting surface on the side of the other end of the first reflecting surface is formed to surround the exhaust port of the second exhaust passage.

18. The heating apparatus according to claim 13, wherein the heating unit includes a temperature sensor configured to detect a change in temperature due to heating, and the heating apparatus includes a control unit configured to control the heat generating unit and/or the cooling unit based on a detection result of the temperature sensor.

19. The heating apparatus according to claim 18, wherein the heating unit includes an exhaust unit configured to exhaust the air supplied to the reflecting surface, and the control unit controls the heat generating unit, the cooling unit, and/or the exhaust unit based on the detection result of the temperature sensor.

* * * * *